United States Patent [19]

Lenz et al.

[11] 4,377,766

[45] Mar. 22, 1983

[54] FRAME FOR UNIT MODULE OF A VACUUM-FLUORESCENT DISPLAY

[75] Inventors: Hartmut Lenz, Neuenbürg; Helmut Thaler, Dettingen, both of Fed. Rep. of Germany

[73] Assignee: International Standard Electric Corporation, New York, NY

[21] Appl. No.: 184,603

[22] Filed: Sep. 5, 1980

[51] Int. Cl.[3] ..... H01J 1/16; H01J 19/10; H01K 19/10

[52] U.S. Cl. ..... 313/244; 313/250; 313/493; 313/497; 313/495

[58] Field of Search ..... 313/493, 494, 495, 496, 313/497, 519, 505, 244, 250, 348, 357, 510

[56] References Cited

U.S. PATENT DOCUMENTS

| | | | |
|---|---|---|---|
| 2,886,731 | 6/1957 | Zappacosta | 313/505 |
| 3,614,773 | 10/1971 | Gordon | 313/244 X |
| 3,638,033 | 1/1972 | Johnson et al. | 313/505 |
| 3,849,693 | 11/1974 | Kuchinsky et al. | 313/519 |
| 4,047,073 | 9/1977 | Kishino | 313/497 |
| 4,223,244 | 9/1980 | Kishino et al. | 313/348 |

*Primary Examiner*—Saxfield Chatmon, Jr.
*Attorney, Agent, or Firm*—John T. O'Halloran

[57] ABSTRACT

A self-supporting frame member mounts a cathode and a control grid in mutual electrical contact to form a unit module that can be secured to other similar unit modules to construct a multi-character vacuum fluorescent display.

13 Claims, 10 Drawing Figures

FRAME FOR UNIT MODULE OF A VACUUM-FLUORESCENT DISPLAY

BACKGROUND OF THE INVENTION

The present invention relates to a vacuum-fluorescent display for presenting alphanumeric characters, comprising a cathode, a control grid, and a substrate for a fluorescent material in an envelope.

Such a display is shown, for example, in DE-AS No. 20 61 187, where the individual parts, such as the control grid or the cathode, are built up one after the other on a base plate. Each part must be precisely positioned—a method which is very expensive, particularly if different arrangements are involved.

SUMMARY OF THE INVENTION

The object of the invention is to provide a vacuum-fluorescent display of the above kind whose design permits simpler fabrication.

Advantages of the invention are that a high density of display elements can be achieved, and that these display elements can be used to form different two-dimensional display systems of almost any area by joining together like modules.

Particularly advantageously, the self-supporting module is constructed with a frame supporting the cathode and the control grid, especially if the frame encloses only three sides of a substantially rectangular module. In a preferred embodiment, the open fourth side of the module is closed by the contiguous frame portion if several modules are fitted together, and by a single, one-sided frame member if there is no contiguous module.

An easy-to-install frame is obtained if the frame has indentations for fitting the control grid therein, and holes for receiving cathode supports.

If the outsides and the open ends of the trilateral frames have identations for receiving adhesives, the frames can be bonded together in an especially simple and neat manner.

The modules can be assembled into a display unit in an advantageous manner if the frames are held together by U-shaped clamps inserted in corresponding holes in the frame.

Another advantageous way of assembling the modules into a display unit is to use a resilient device grasping all modules of a display unit.

BRIEF DESCRIPTION OF THE DRAWINGS

An embodiment of the invention will now be explained in more detail with reference to the accompanying drawings, in which.

DETAILED DESCRIPTION OF THE PREFERRED EMBODIMENTS

Figure 1:
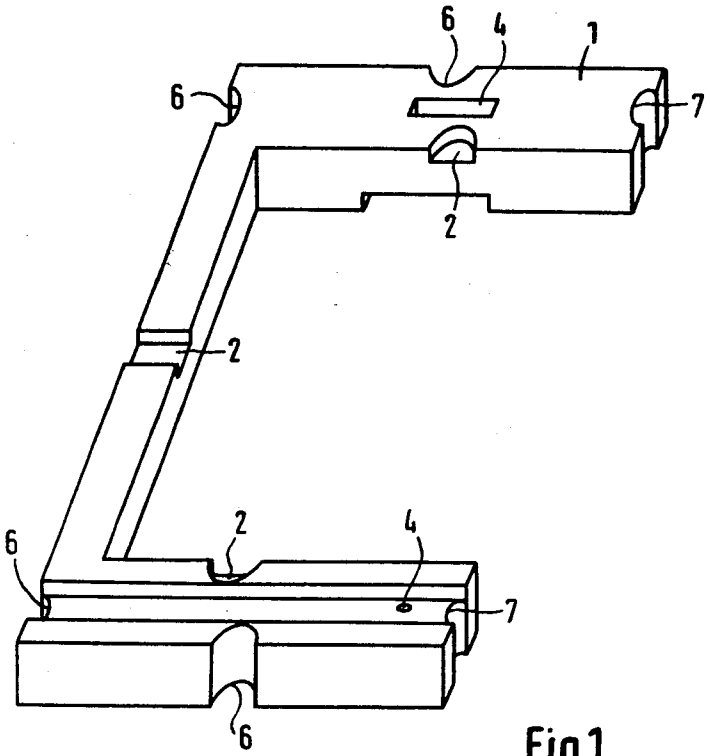
FIG. 1 shows a frame according to the invention.

The frame 1 shown in FIG. 1 is provided with indentations 2 for receiving a control grid 3, with holes 4 for receiving cathode members 5, with indentations 6 on its outside, and with indentations 7 at its open ends.

Figure 2:
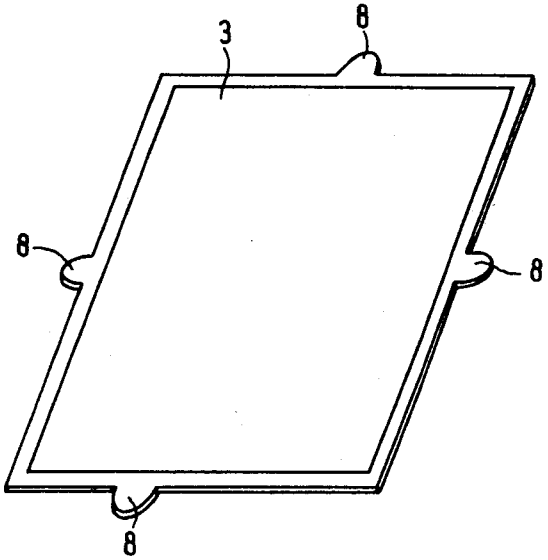
FIG. 2 shows the control grid fitting the frame of FIG. 1.
Figure 3:
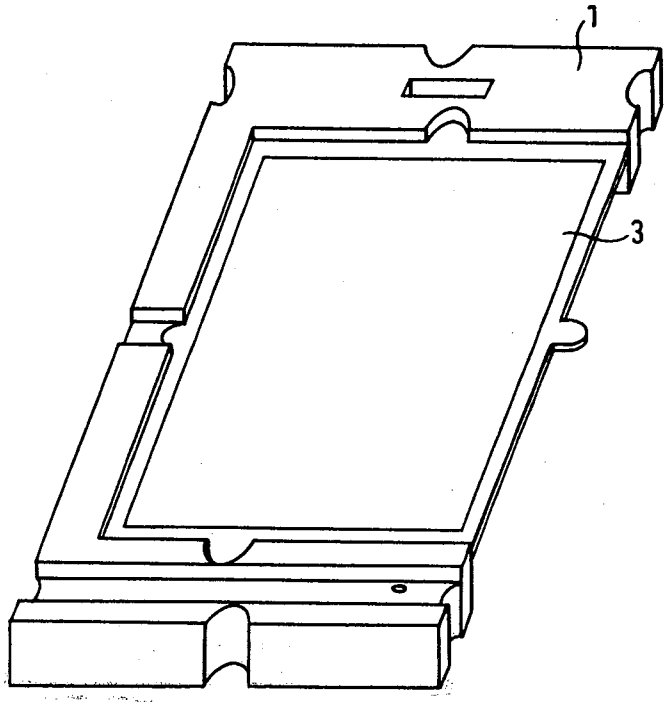
FIG. 3 shows the frame of FIG. 1 with the control grid fitted therein.
Figure 5:
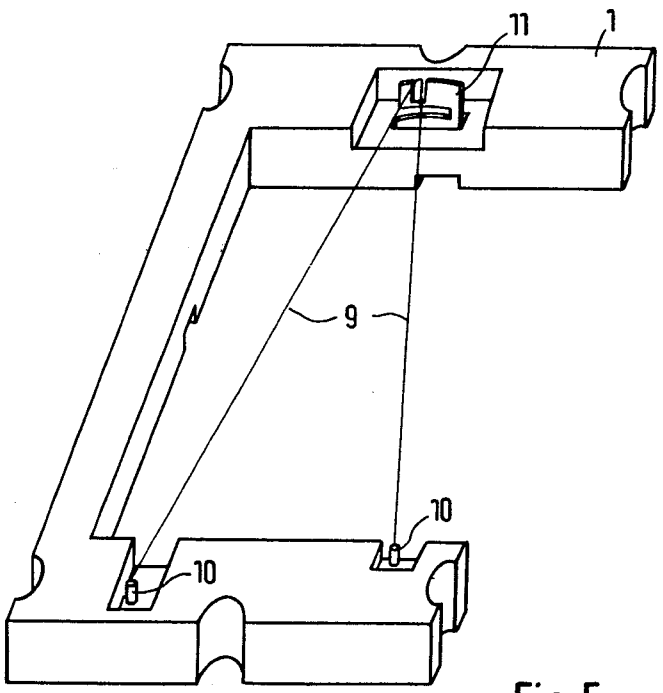
FIG. 5 shows the frame of FIG. 1 with cathode members fitted therein.
Figure 4:
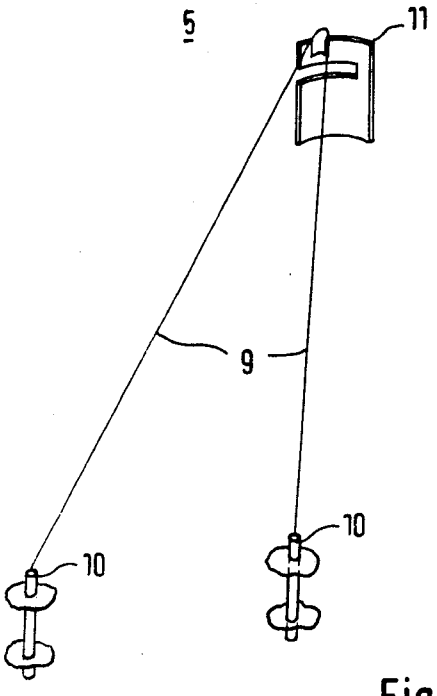
FIG. 4 shows the cathode members fitting the frame of FIG. 1.

FIG. 2 shows a control grid 3 fitting such a frame. It has noses 8, which fit into the indentations 2 of the frame. FIG. 3 shows the frame 1 with the control grid 3 mounted therein. FIG. 4 shows the cathode members 5 fitting the frame of FIG. 1. They consist of a directly heated filament 9, two retaining pins 10, and a retaining spring 11. FIG. 5 shows how the cathode members 5 are inserted in the holes 4 of the frame 1.

Figure 6:
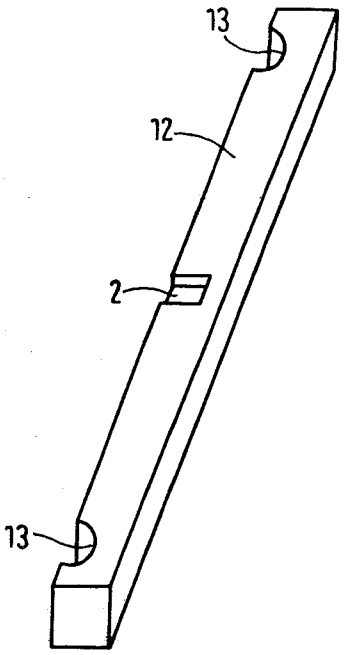
FIG. 6 shows a one-sided frame member.

FIG. 6 shows a one-sided frame member 12 with an indentation 2 for receiving the control grid 3 and with indentations 13, which are opposite the indentations 2 during assembly.

Figure 7:
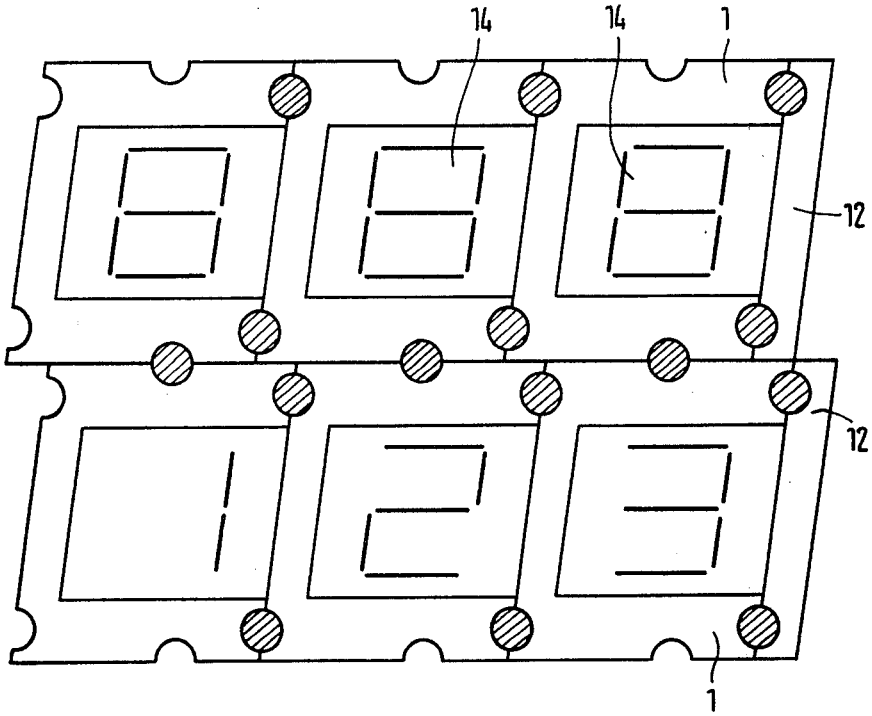
FIG. 7 shows an example of how the modules according to the invention can be fitted together.

How the frames 1 and the frame members 12 are joined together to form a multi-character display unit is shown in the embodiment of FIG. 7. Here the opposite indentations 6, 7 and 13 serve to receive adhesives or glass frit, so that the frames can be joined together into a single rugged unit. Depending on the type of display, the digits 14 can be viewed through the filament and the grid electrode, or the modules are disposed on that side of the fluorescent screen facing away from the viewer, and thus remain invisible to the viewer.

Figure 8:
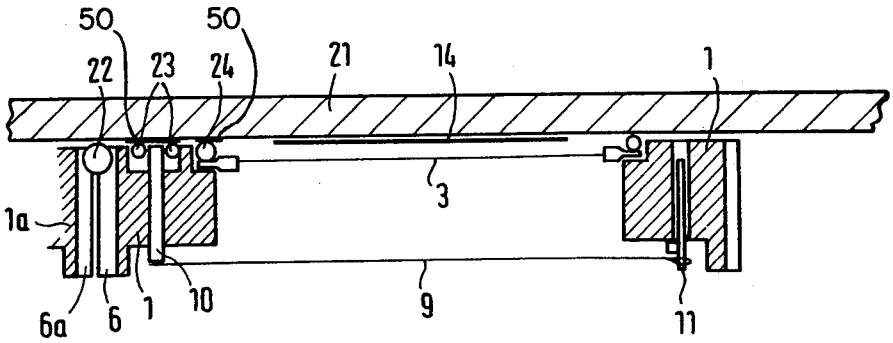
FIG. 8 shows a section of a module in connection with a substrate on which the fluorescent material is deposited.

FIG. 8 shows a section of a module according to the invention in connection with a substrate 21, which has a fluorescent material 14 deposited on its inside.

The substrate 21 is extended around the module shown to form a vacuum envelope in a manner familiar to those skilled in the art. Mounted on the inside of the substrate 21 are a module 1 with the frame 1, and another contiguous module (shown in part) with the frame 1*a*.

The frames 1 and 1*a* are joined together and to the substrate 21 in a simple manner by introducing adhesives 22 into the opposite indentations 6 and 6*a*. If the frames and the substrate are made of glass or ceramic, the adhesive 22 can be glass frit. The ball shown for the adhesive 22 becomes liquid when heated and, after cooling down, makes a good joint between the parts.

The pin 10 serves to make electric connection to the filament 9, and its end facing the substrate 21 is joined to the latter by electrically conductive adhesives 23. In this manner, electric connection to the filament 9 is made via conductors 50 deposited on the substrate.

If electrically conductive adhesives 24 are also used between the substrate 21 and the control grid 3, the latter may be electrically connected conductors so deposited on the substrate 21.

Figure 9:
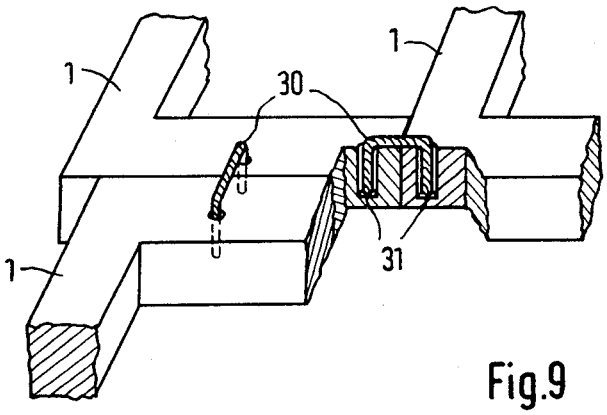
FIG. 9 shows the position and design of a U-shaped clamp.

The embodiment of FIG. 9 shows how the frames 1 are provided with holes 31 and held together by means of clamps 30 fitted into these holes.

Figure 10:
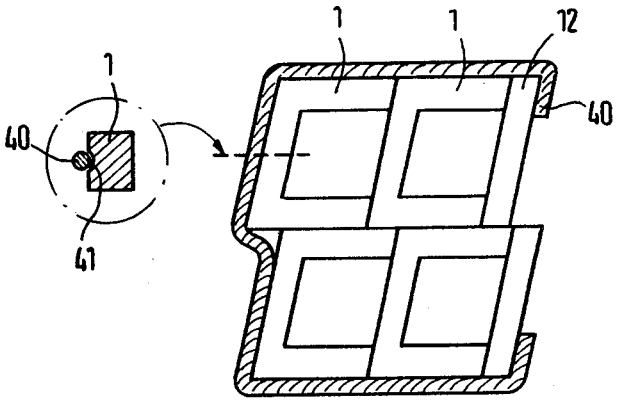
FIG. 10 shows the position and design of a resilient device grasping the modules.

FIG. 10 shows another embodiment in which several frames 1, including one-sided frame members 12, are held together with a resilient device 40 to form a display unit.

This resilient device may be, for example, suitably shaped spring strip or spring wire. Especially if spring wire is used, the frames 1 and the frame members 12 are advantageously provided with an outside groove 41 adapted to the shape of the device 40.

The means for holding together modules of a display unit which are shown in FIGS. 9 and 10 can be used by themselves but also in conjunction with the above-described bonding technique, and represent particularly suitable aids for an accurate and simple assembly of the individual modules into a display unit.

Although this invention has been described by referring to specific embodiments thereof, it will be understood that various changes and modifications will be suggested to one skilled in the art, and it is intended to encompass such changes and modifications as are within the scope of the following claims.

What is claimed is:

1. A substantially self-supporting, flat frame member for mounting a cathode and a control grid to form a unit module for a vacuum-fluorescent display, the frame member including leg means comprising an open frame for surrounding all but a portion of the periphery of the control grid and also including attachment means for securing the frame member to a second, substantially identical frame member of an adjacent unit module such that said open frame is closed by the leg means of the second frame member to construct a multi-character display wherein the control grid is completely surrounded by leg means.

2. A frame member as recited in claim 1 comprising a C-shaped frame with two legs connected by an upright portion.

3. A substantially self-supporting frame member for mounting a cathode and a control grid to form a unit module for a vacuum-fluorescent display, the frame member including attachment means for securing the frame member to the frame member of an adjacent unit module to construct a multi-character display, wherein said frame member comprises a C-shaped frame with two legs connected by an upright portion and said attachment means comprises:

two end-attachment means, one on the end of each of said legs;

two side-attachment means, one on each of said legs, for cooperating with the side-attachment means of an adjacent unit module;

and two upright-attachment means, one at each end of said upright member, for cooperating with the end-attachment means of an adjacent unit module.

4. The frame member recited in claim 3 wherein said attachment means comprise indentations on the outside periphery of said C-shaped frame for receiving an adhesive to adhere adjacent frames together.

5. The frame member recited in claim 3 wherein said attachment means comprise holes in the face of said C-shaped frame for receiving clips to hold adjacent frames together.

6. The frame member recited in claim 2 wherein said attachment means comprise a groove in the outer periphery of said C-shaped frame for accepting a spring element to hold adjacent frames together.

7. A unit module for a vacuum-fluorescent display, the unit module comprising a self-supporting C-shaped frame, having two legs connected by an upright portion, a cathode, and a parallelogram-shaped control grid wherein:

said C-shaped frame includes cathode mounting means for securing said cathode to said frame, first control grid mounting means for securing three sides of said control grid to said legs and upright portion of said frame, second control grid mounting means in said upright portion for securing to said frame the fourth, unsecured side of a control grid secured in a substantially identical, second unit module adjacent to said unit module and attachment means for securing said frame to the frame member of an adjacent unit module; and said control grid includes interframe mounting means for securing the fourth, unsecured side thereof to an adjacent frame element.

8. The unit module recited in claim 7 wherein said attachment means comprises:

two end-attachment means, one on the end of each of said legs;

two side-attachment means, one on each of said legs, for cooperating with the side-attachment means of an adjacent unit module; and two upright-attachment means, one at each end of said upright member, for cooperating with the end-attachment means of an adjacent unit module.

9. The unit module recited in claim 8 wherein said attachment means comprise indentations on the outside periphery of said C-shaped frame for receiving an adhesive to adhere adjacent frames together.

10. The unit module recited in claim 8 wherein said attachment means comprise holes in the face of said C-shaped frame for receiving clips to hold adjacent frames together.

11. The unit module recited in claim 7 wherein said attachment means comprises a groove in the outer periphery of said C-shaped frame for accepting a spring element to hold adjacent frames together.

12. The unit module recited in claim 7 wherein:

said cathode mounting means comprises two retaining pins in one leg of and extending from the first face of said C-shaped frame and a retaining spring in the other leg of and extending from the same face of said C-shaped frame;

said cathode comprises a wire disposed across the first face of said C-shaped frame and having one end secured to one of said retaining pins and the other end secured to the other of said retaining pins and secured intermediate its two ends to said retaining spring;

said upright portion of said C-shaped frame includes a groove extending across said upright portion in the second face of said C-shaped frame;

said first control grid mounting means comprises said groove and two niches, one in each leg of and in the second face of said C-shaped frame;

said second control grid mounting means comprises said groove; and said control grid comprises a parallelogram element having a tongue on each side thereof, three of said tongues being mounted in said first control grid mounting means.

13. The unit module recited in claim 7 further comprising a frame-completing element for attachment to the ends of the legs of said C-shaped frame and to said interframe mounting means of said control grid.

* * * * *